US011670234B2

(12) United States Patent
Lee et al.

(10) Patent No.: US 11,670,234 B2
(45) Date of Patent: Jun. 6, 2023

(54) DISPLAY DEVICE AND DISPLAY DRIVING METHOD

(71) Applicant: LG DISPLAY CO., LTD., Seoul (KR)

(72) Inventors: SeungHyuck Lee, Seoul (KR); Seungjong Bong, Gyeonggi-do (KR); KiPyo Hong, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/862,085

(22) Filed: Jul. 11, 2022

(65) Prior Publication Data

US 2023/0081260 A1 Mar. 16, 2023

(30) Foreign Application Priority Data

Sep. 15, 2021 (KR) ..... 10-2021-0123330

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2310/08* (2013.01); *G09G 2320/048* (2013.01); *G09G 2330/021* (2013.01); *G09G 2360/16* (2013.01)

(58) Field of Classification Search
None
See application file for complete search history.

(56) References Cited

U.S. PATENT DOCUMENTS

2014/0084792 A1* 3/2014 Oh ..... H05B 47/10 315/120
2015/0103106 A1* 4/2015 Chaji ..... G09G 3/3225 345/690
2015/0243218 A1* 8/2015 Tseng ..... G09G 3/3258 345/212
2016/0035280 A1* 2/2016 Kim ..... G09G 3/3233 345/80
2016/0217722 A1* 7/2016 Fujii ..... G09G 3/2003
2018/0020525 A1* 1/2018 Moon ..... G09G 5/10
2021/0201815 A1* 7/2021 Bong ..... G09G 3/3266
2021/0366392 A1* 11/2021 Hong ..... G09G 3/3233
2022/0013049 A1* 1/2022 Pyun ..... G09G 3/3233

* cited by examiner

*Primary Examiner* — Sepehr Azari
(74) *Attorney, Agent, or Firm* — Morgan, Lewis & Bockius LLP

(57) ABSTRACT

Embodiments of the present disclosure relate to a display device and a display driving method. Specifically, there may be provided a display driving method including detecting a driving current per block unit, for a display panel where a plurality of subpixels are disposed, scaling driving current data per block unit to driving current data per subpixel unit, calculating first compensation data by comparing the driving current data per subpixel unit with target data, calculating final compensation data by comparing the first compensation data with guide data, and compensating for a characteristic value for the plurality of subpixels based on the final compensation data.

20 Claims, 13 Drawing Sheets

DISPLAY DEVICE AND DISPLAY DRIVING METHOD

CROSS-REFERENCE TO RELATED APPLICATION

This application claims priority from Korean Patent Application No. 10-2021-0123330, filed on Sep. 15, 2021, which is hereby incorporated by reference for all purposes as if fully set forth herein.

BACKGROUND

Technical Field

Embodiments of the present disclosure relate to a display device and a display driving method capable of effectively compensating for a characteristic value of a driving transistor constituting a subpixel.

Discussion of the Related Art

As the information society develops, various demands for display devices for displaying images are increasing, and various types of display devices, such as liquid crystal displays (LCDs) and organic light emitting displays, are used.

Among these display devices, the organic light emitting diode display adopts organic light emitting diodes and thus has fast responsiveness and various merits in contrast ratio, luminous efficiency, brightness, and viewing angle.

The organic light emitting diode display include organic light emitting diodes in subpixels arranged on the display panel and makes the organic light emitting diodes emit light by controlling the current flowing to the organic light emitting diodes, thereby controlling the brightness represented by each subpixel while displaying an image.

Each subpixel disposed on the display panel of the display device has a light emitting element and a driving transistor for driving the light emitting element. The characteristic value of the driving transistor in each subpixel may vary depending on the driving time of the display panel or a deviation between the characteristic values of the driving transistors may occur due to a difference in driving time between subpixels.

Thus, since a luminance deviation (luminance non-uniformity) between subpixels may occur and image quality may be degraded. To address the luminance deviation between subpixels, techniques for sensing and compensating for a deviation between the characteristic values of driving transistors are used.

Recent display devices have an increased resolution to meet users' needs. Thus, it may take longer to sense and compensate for characteristic values for driving transistors due to the increased resolution.

In particular, the characteristic values of the driving transistor include the threshold voltage and the mobility. Measurement of the threshold voltage is performed at the time when the driving transistor reaches the saturated state and requires a longer compensation time than mobility measurement.

SUMMARY

Accordingly, embodiments of the present disclosure are directed to a display device and a display driving method that substantially obviate one or more of the problems due to limitations and disadvantages of the related art.

An aspect of the present disclosure is to provide a display device and a display driving method capable of effectively compensating for a characteristic value of a driving transistor constituting a subpixel.

Another aspect of the present disclosure is to provide a display device and a display driving method capable of shortening the compensation time for the characteristic value of the driving transistor by detecting current for each block of the display panel.

Another aspect of the present disclosure is to provide a display device and a display driving method capable of enhancing the accuracy of compensation for the characteristic value of the driving transistor by compensating for the current data detected for each block based on target data and guide data.

Another aspect of the present disclosure is to provide a display driving method comprising detecting driving currents per block unit for a display panel including a plurality of subpixels, scaling driving current data per block unit to driving current data per subpixel unit, calculating first compensation data by comparing the driving current data per subpixel unit with target data, calculating final compensation data by comparing the first compensation data with guide data, and compensating for a characteristic value for the plurality of subpixels based on the final compensation data.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a display device comprises a display panel including a plurality of subpixels, a data driving circuit configured to supply a data voltage to the display panel, a power management circuit configured to supply a driving current to the display panel through a driving voltage line, a driving current detecting circuit configured to detect a driving current per block unit for the display panel, and a timing controller configured to scale driving current data per block unit generated from the driving current detecting circuit to driving current data per subpixel unit, calculate first compensation data by comparing the driving current data per subpixel unit with target data, calculate final compensation data by comparing the first compensation data with guide data, and compensate for a characteristic value for the plurality of subpixels based on the final compensation data.

According to embodiments of the present disclosure, there may be provided a display device and a display driving method capable of effectively compensating for a characteristic value of a driving transistor constituting a subpixel.

According to embodiments of the present disclosure, there may be provided a display device and a display driving method capable of shortening the compensation time for the characteristic value of the driving transistor by detecting current for each block of the display panel.

According to embodiments of the present disclosure, there may be provided a display device and a display driving method capable of enhancing the accuracy of compensation for the characteristic value of the driving transistor by compensating for the current data detected for each block based on target data and guide data.

It is to be understood that both the foregoing general description and the following detailed description are exemplary and explanatory and are intended to provide further explanation of the inventive concepts as claimed.

BRIEF DESCRIPTION OF DRAWINGS

The accompanying drawings, which are included to provide a further understanding of the disclosure and are incorporated in and constitute a part of this application, illustrate embodiments of the disclosure and together with the description serve to explain various principles. In the drawings.

DETAILED DESCRIPTION

Figure 1:
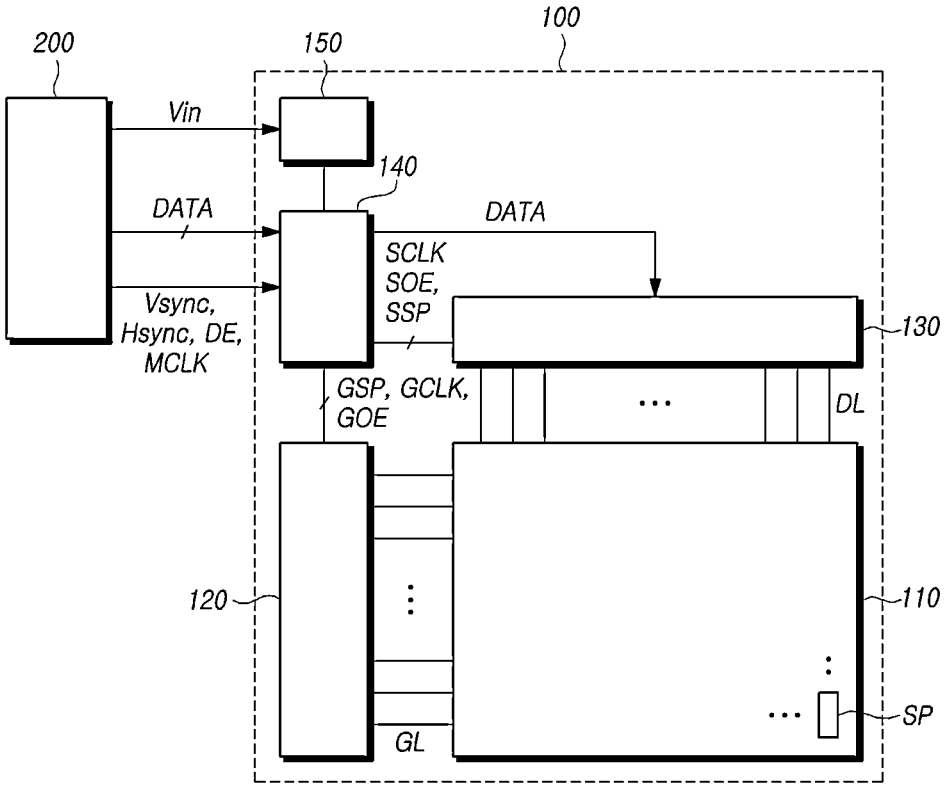
FIG. 1 is a view schematically illustrating a configuration of a display device according to various embodiments of the present disclosure.

Hereinafter, embodiments of the present disclosure will be described in detail with reference to exemplary drawings. In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

Hereinafter, various embodiments of the present disclosure will be described in detail with reference to the accompanying drawings.

FIG. 1 is a view schematically illustrating a configuration of a display device according to various embodiments of the present disclosure.

Referring to FIG. 1, a display device 100 according to embodiments of the present disclosure may include a display panel 110 where a plurality of gate lines GL and data lines DL are connected, and a plurality of subpixels SP are arranged in a matrix form, a gate driving circuit 120 driving the plurality of gate lines GL, a data driving circuit 130 supplying a data voltage through the plurality of data lines DL, a timing controller 140 controlling the gate driving circuit 120 and the data driving circuit 130, and a power management circuit 150.

The display panel 110 displays an image based on a scan signal transferred from the gate driving circuit 120 through the plurality of gate line GL and the data voltage transferred from the data driving circuit 130 through the plurality of data lines DL.

In the case of a liquid crystal display, the display panel 110 may include a liquid crystal layer formed between two substrates and may be operated in any known mode, such as a twisted nematic (TN) mode, a vertical alignment (VA) mode, an in-plane switching (IPS) mode, or a fringe field switching (FFS) mode. In the case of an organic light emitting display, the display panel 110 may be implemented in a top emission scheme, a bottom emission scheme, or a dual-emission scheme.

In the display panel 110, a plurality of pixels may be arranged in a matrix form, and each pixel may include subpixels SP having different colors, e.g., a white subpixel, a red subpixel, a green subpixel, and a blue subpixel, and each subpixel SP may be defined by the plurality of data lines DL and the plurality of gate lines GL.

One subpixel SP may include, e.g., a thin film transistor (TFT) formed at the intersection between one data line DL and one gate line GL, a light emitting element, such as an organic light emitting diode, charged with the data voltage, and a storage capacitor electrically connected to the light emitting element to maintain the voltage.

For example, when the display device 100 having a resolution of 2,160×3,840 includes four subpixels SP of white (W), red (R), green (G), and blue (B), 3,840 data lines DL may be connected to 2,160 gate lines GL and four subpixels WRGB, and thus, there may be provided 3,840×4=15,360 data lines DL. Each subpixel SP is disposed at the intersection between the gate line GL and the data line DL.

The gate driving circuit 120 may be controlled by the controller 140 to sequentially output scan signals to the plurality of gate lines GL disposed in the display panel 110, controlling the driving timing of the plurality of subpixels SP.

In the display device 100 having a resolution of 2,160×3,840, sequentially outputting the scan signal to the 2,160 gate lines GL from the first gate line to the 2,160th gate line may be referred to as 2,160-phase driving. Sequentially outputting the scan signal to each unit of four gate lines GL, e.g., sequentially outputting the scan signal to the fifth gate line to the eighth gate line after sequentially outputting the scan signal to the first gate line to the fourth gate line, is referred to as 4-phase driving. In other words, sequentially outputting the scan signal to every N gate lines GL may be referred to as N-phase driving.

The gate driving circuit 120 may include one or more gate driving integrated circuits (GDICs). Depending on driving schemes, the gate driving circuit 120 may be positioned on only one side, or each of two opposite sides, of the display panel 110. The gate driving circuit 120 may be implemented in a gate-in-panel (GIP) form which is embedded in the bezel area of the display panel 110.

The data driving circuit 130 receives image data DATA from the timing controller 140 and converts the received image data DATA into an analog data voltage. Then, as the data voltage is output to each data line DL according to the timing when the scan signal is applied through the gate line GL, each subpixel SP connected to the data line DL displays a light emitting signal having the brightness corresponding to the data voltage.

Likewise, the data driving circuit 130 may include one or more source driving integrated circuits SDIC, and the source driving integrated circuit SDIC may be connected to the bonding pad of the display panel 110 in a tape automated bonding (TAB) type or a chip-on-glass (COG) type or may be disposed directly on the display panel 110.

In some cases, each source driving integrated circuit SDIC may be integrated and disposed on the display panel 110. Further, each source driving integrated circuit SDIC may be implemented in a chip-on-film (COF) type and, in this case, each source driving integrated circuit SDIC may be mounted on a circuit film and may be electrically connected to the data line DL of the display panel 110 through the circuit film.

The timing controller 140 supplies various control signals to the gate driving circuit 120 and the data driving circuit 130 and controls the operation of the gate driving circuit 120 and the data driving circuit 130. In other words, the timing controller 140 may control the gate driving circuit 120 to output a scan signal according to the timing implemented in each frame and, on the other hand, transfers the image data DATA received from the outside to the data driving circuit 130.

In this case, the timing controller 140 receives, from an external host system 200, several timing signals including, e.g., a vertical synchronization signal Vsync, a horizontal synchronization signal Hsync, a data enable signal DE, and a main clock MCLK, together with the image data DATA.

The host system 200 may be any one of a television (TV) system, a set-top box, a navigation system, a personal computer (PC), a home theater system, a mobile device, and a wearable device.

Accordingly, the timing controller 140 may generate a control signal according to various timing signals received from the host system 200 and transfers the control signal to the gate driving circuit 120 and the data driving circuit 130.

For example, the timing controller 140 outputs several gate control signals including, e.g., a gate start pulse GSP, a gate clock GCLK, and a gate output enable signal GOE, to control the gate driving circuit 120. The gate start pulse GSP controls the timing at which one or more gate driving integrated circuits GDIC constituting the gate driving circuit 120 start operation. The gate clock GCLK is a clock signal commonly input to one or more gate driving integrated circuits GDIC and controls the shift timing of the scan signal. The gate output enable signal GOE designates timing information about one or more gate driving integrated circuits GDICs.

The timing controller 140 outputs various data control signals including, e.g., a source start pulse SSP, a source sampling clock SCLK, and a source output enable signal SOE, to control the data driving circuit 130. The source start pulse SSP controls the timing at which one or more source driving integrated circuits SDIC constituting the data driving circuit 130 start data sampling. The source sampling clock SCLK is a clock signal that controls the timing of sampling data in the source driving integrated circuit SDIC. The source output enable signal SOE controls the output timing of the data driving circuit 130.

The display device 100 may further include a power management circuit 150 that supplies various voltages or currents to, e.g., the display panel 110, the gate driving circuit 120, and the data driving circuit 130 or controls various voltages or currents to be supplied.

The power management circuit 150 adjusts the direct current (DC) input voltage Vin supplied from the host system 200, generating power required to drive the display panel 100, the gate driving circuit 120, and the data driving circuit 130.

The subpixel SP is positioned at the intersection between the gate line GL and the data line DL, and a light emitting element may be disposed in each subpixel SP. For example, the organic light emitting diode display may include a light emitting element, such as an organic light emitting diode, in each subpixel SP and may display an image by controlling the current flowing to the light emitting element according to the data voltage.

The display device 100 may be one of various types of devices, such as liquid crystal displays, organic light emitting diode displays, or plasma display panels.

Figure 2:
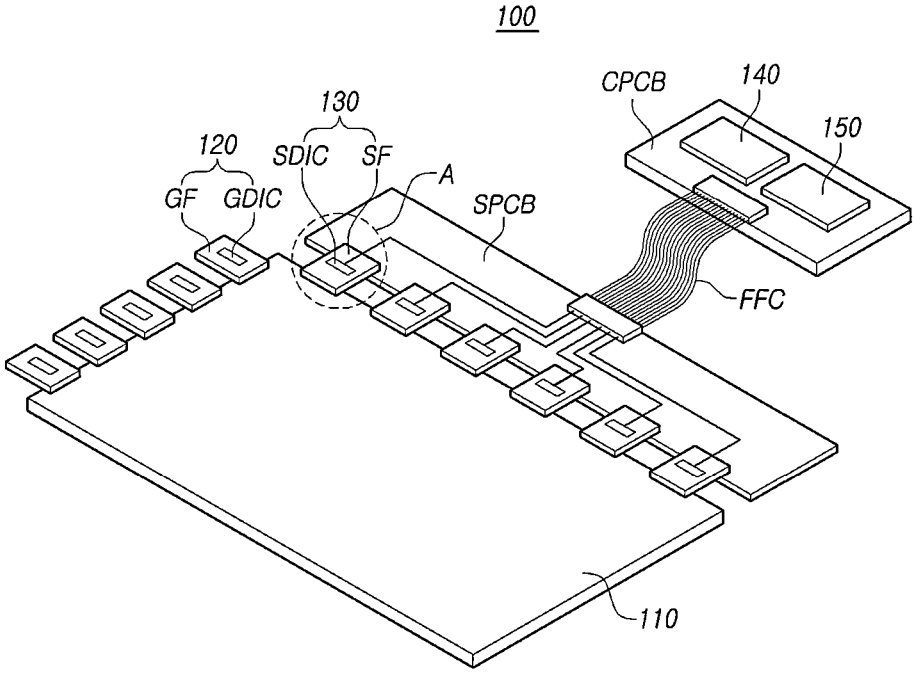
FIG. 2 is a view illustrating an example of a system of a display device according to embodiments of the present disclosure.

FIG. 2 is a view illustrating an example of a system of a display device according to embodiments of the present disclosure;

Referring to FIG. 2, in the display device 100 according to embodiments of the present disclosure, the source driving integrated circuit SDIC included in the data driving circuit 130 and the gate driving integrated circuit GDIC included in the gate driving circuit 120 are implemented in the chip-on-film (COF) type among various types (e.g., TAB, COG, or COF).

One or more gate driving integrated circuits GDIC included in the gate driving circuit 120 each may be mounted on a gate film GF, and one side of the gate film GF may be electrically connected with the display panel 110. Lines for electrically connecting the gate driving integrated circuit GDIC and the display panel 110 may be disposed on the gate film GF.

Likewise, one or more source driving integrated circuits SDIC included in the data driving circuit 130 each may be mounted on the source film SF, and one side of the source film SF may be electrically connected with the display panel 110. Lines for electrically connecting the source driver integrated circuit SDIC and the display panel 110 may be disposed on the source film SF.

The display device 100 may include at least one source printed circuit board SPCB for circuit connection between a plurality of source driving integrated circuits SDIC and other devices and a control printed circuit board CPCB for mounting control components and various electric devices.

The other side of the source film SF where the source driving integrated circuit SDIC is mounted may be connected to at least one source printed circuit board SPCB. In other words, one side of the source film SF where the source driving integrated circuit SDIC is mounted may be electrically connected with the display panel 110, and the other side thereof may be electrically connected with the source printed circuit board SPCB.

The timing controller 140 and the power management circuit (power management IC) 150 may be mounted on the control printed circuit board CPCB. The timing controller 140 may control the operation of the data driving circuit 130 and the gate driving circuit 120. The power management circuit 150 may supply driving voltage or current to the display panel 110, the data driving circuit 130, and the gate driving circuit 120 and control the supplied voltage or current.

At least one source printed circuit board SPCB and control printed circuit board CPCB may be circuit-connected through at least one connection member. The connection member may include, e.g., a flexible printed circuit (FPC) or a flexible flat cable (FFC). In this case, the connection member connecting the at least one source printed circuit board SPCB and control printed circuit board CPCB may be varied depending on the size and type of the display device 100. The at least one source printed circuit board SPCB and control printed circuit board CPCB may be integrated into a single printed circuit board.

In the so-configured display device 100, the power management circuit 150 transfers a driving voltage necessary for display driving or characteristic value sensing to the source printed circuit board SPCB through the flexible printed circuit FPC or flexible flat cable FFC. The driving voltage transferred to the source printed circuit board SPCB is supplied to emit light or sense a specific subpixel SP in the display panel 110 through the source driving integrated circuit SDIC.

Each of the subpixels SP arranged in the display panel 110 in the display device 100 may include an organic light emitting diode, which is a light emitting element, and a circuit element, e.g., a driving transistor, for driving the organic light emitting diode.

The type and number of circuit elements constituting each subpixel SP may be varied depending on functions to be provided and design schemes.

Figure 3:
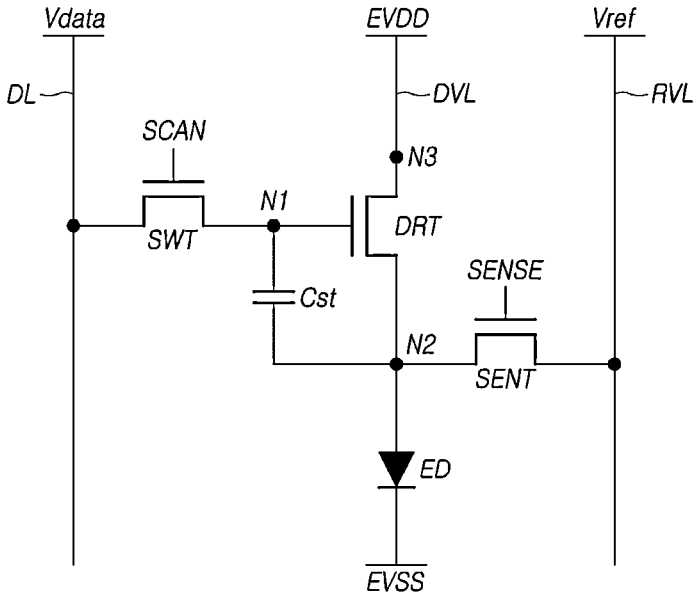
FIG. 3 is a view illustrating an example of a circuit constituting a subpixel in a display device according to embodiments of the present disclosure.

FIG. 3 is a view illustrating an example of a circuit constituting a subpixel in a display device according to embodiments of the present disclosure.

Referring to FIG. 3, in the display device 100 according to embodiments of the present disclosure, the subpixel SP may include one or more transistors and a capacitor and an organic light emitting diode (OLED) as a light emitting element ED.

For example, the subpixel SP may include a driving transistor DRT, a switching transistor SWT, a sensing transistor SENT, a storage capacitor Cst, and a light emitting element ED.

The driving transistor DRT includes the first node N1, second node N2, and third node N3. The first node N1 of the driving transistor DRT may be a gate node to which the data voltage Vdata is applied from the data driving circuit 130 through the data line DL when the switching transistor SWT is turned on. The second node N2 of the driving transistor DRT may be electrically connected with the anode electrode of the light emitting element ED and may be the source node or drain node. The third node N3 of the driving transistor DRT may be electrically connected with the driving voltage line DVL to which the driving voltage EVDD is applied and may be the drain node or the source node.

In this case, during a display driving period, a driving voltage EVDD necessary for displaying an image may be supplied to the driving voltage line DVL. For example, the driving voltage EVDD necessary for displaying an image may be 27V.

The switching transistor SWT is electrically connected between the first node N1 of the driving transistor DRT and the data line DL, and the gate line GL is connected to the gate node. Thus, the switching transistor SWT is operated according to the scan signal SCAN supplied through the gate line GL. When turned on, the switching transistor SWT transfers the data voltage Vdata supplied through the data line DL to the gate node of the driving transistor DRT, thereby controlling the operation of the driving transistor DRT.

The sensing transistor SENT is electrically connected between the second node N2 of the driving transistor DRT and the reference voltage line RVL, and the gate line GL is connected to the gate node. The sensing transistor SENT is operated according to the sense signal SENSE supplied through the gate line GL. When the sensing transistor SENT is turned on, a sensing reference voltage Vref supplied through the reference voltage line RVL is transferred to the second node N2 of the driving transistor DRT.

In other words, as the switching transistor SWT and the sensing transistor SENT are controlled, the voltage of the first node N1 and the voltage of the second node N2 of the driving transistor DRT are controlled, so that the current for driving the light emitting element ED may be supplied.

The gate nodes of the switching transistor SWT and the sensing transistor SENT may be commonly connected to one gate line GL or may be connected to different gate lines GL. An example is shown in which the switching transistor SWT and the sensing transistor SENT are connected to different gate lines GL in which case the switching transistor SWT and the sensing transistor SENT may be independently controlled by the scan signal SCAN and the sense signal SENSE transferred through different gate lines GL.

In contrast, if the switching transistor SWT and the sensing transistor SENT are connected to one gate line GL, the switching transistor SWT and the sensing transistor SENT may be simultaneously controlled by the scan signal SCAN or sense signal SENSE transferred through one gate line GL, and the aperture ratio of the subpixel SP may be increased.

The transistor disposed in the subpixel SP may be an n-type transistor or a p-type transistor and, in the shown example, the transistor is an n-type transistor.

The storage capacitor Cst is electrically connected between the first node N1 and second node N2 of the driving transistor DRT and maintains the data voltage Vdata during one frame.

The storage capacitor Cst may also be connected between the first node N1 and third node N3 of the driving transistor DRT depending on the type of the driving transistor DRT. The anode electrode of the light emitting element ED may be electrically connected with the second node N2 of the driving transistor DRT, and a base voltage EVSS may be applied to the cathode electrode of the light emitting element ED.

The base voltage EVSS may be a ground voltage or a voltage higher or lower than the ground voltage. The base voltage EVSS may be varied depending on the driving state. For example, the base voltage EVSS at the time of display driving and the base voltage EVSS at the time of sensing driving may be set to differ from each other.

The structure of the subpixel SP described above as an example is a 3T (transistor) 1C (capacitor) structure, which is merely an example for description, and may further include one or more transistors or, in some cases, one or more capacitors. The plurality of subpixels SP may have the same structure, or some of the plurality of subpixels SP may have a different structure.

To effectively sense a characteristic value, e.g., threshold voltage or mobility, of the driving transistor DRT, the display device 100 according to embodiments of the present disclosure may use a method for measuring the current flowed by the voltage charged to the storage capacitor Cst during a characteristic value sensing period of the driving transistor DRT, which is called current sensing.

In other words, it is possible to figure out the characteristic value, or a variation in characteristic value, of the driving transistor DRT in the subpixel SP by measuring the current flowed by the voltage charged to the storage capacitor Cst during the characteristic value sensing period of the driving transistor DRT.

In this case, the reference voltage line RVL serves not only to transfer the reference voltage Vref but also as a sensing line for sensing the characteristic value of the driving transistor DRT in the subpixel SP. Thus, the reference voltage line RVL may also be referred to as a sensing line.

In this case, the period for sensing the characteristic values (threshold voltage and mobility) of the driving transistor DRT may be performed after the power-on signal is generated and before the display driving starts. For example, if a power-on signal is applied to the display device 100, the timing controller 140 loads parameters necessary for driving the display panel 110 and then drives the display.

In this case, the parameters necessary for driving the display panel 110 may include information about the sensing and compensation for characteristic values previously performed on the display panel 110. In the parameter loading process, the sensing of characteristic values (threshold voltage and mobility) of the driving transistor DRT may be performed. As described above, a process in which the characteristic value is sensed in the parameter loading process after the power-on signal is generated is referred to as an on-sensing process.

Alternatively, a period in which the characteristic value of the driving transistor DRT is sensed may proceed after a power-off signal of the display device 100 is generated. For example, when a power-off signal is generated in the display device 100, the timing controller 140 may cut off the data voltage Vdata supplied to the display panel 110 and may sense the characteristic value of the driving transistor DRT for a predetermined time. As such, a process in which a characteristic value is sensed in a state in which the data voltage Vdata is cut off as a power-off signal is generated is referred to as an off-sensing process.

Alternatively, the sensing period for the characteristic value of the driving transistor DRT may be performed in real time while the display is driven. This sensing process is referred to as a real-time (RT) sensing process. In the real-time sensing process, the sensing process may be performed on one or more subpixels SP in one or more subpixel SP lines at each blank period during the display driving period.

However, as the resolution of the display device 100 is increasing according to the development of technology and the needs of users, it takes a long time to sense and compensate for the characteristic value of the driving transistor DRT for each subpixel SP due to the subpixels SP implementing the high resolution.

In particular, the characteristic values of the driving transistor DRT include the threshold voltage and the mobility. Measurement of the threshold voltage is performed at the time when the driving transistor DRT reaches the saturated state and requires a longer compensation time than mobility measurement.

According to embodiments of the present disclosure, there may be provided a display device and a display driving method capable of enhancing the accuracy of compensation for the characteristic value of the driving transistor DRT while shortening the sensing time for the characteristic value of the driving transistor.

Figure 4:
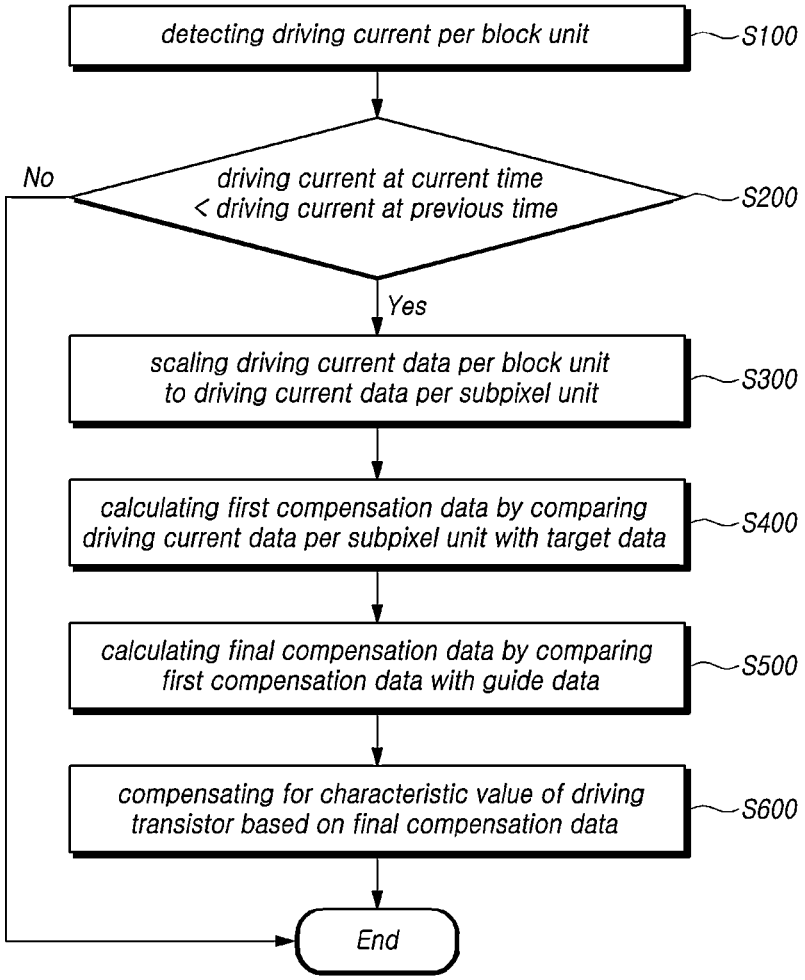
FIG. 4 is a flowchart illustrating a display driving method according to embodiments of the present disclosure.

FIG. 4 is a flowchart illustrating a display driving method according to embodiments of the present disclosure.

Referring to FIG. 4, a display driving method according to embodiments of the present disclosure may include a step S100 of detecting a driving current per block unit, a step S200 of comparing a driving current at the current time with a driving current at a previous time, a step S300 of scaling driving current data per block unit to driving current data per subpixel unit, a step S400 of comparing the driving current data per subpixel unit with target data to calculate first compensation data, a step S500 of comparing the first compensation data with guide data to calculate final compensation data, and a step S600 of compensating for a characteristic value of a driving transistor DRT based on the final compensation data.

The step S100 of detecting the driving current per block unit is a process for dividing the subpixels SP of the display panel 110 into blocks and detecting the driving current for each block of subpixels SP.

To that end, the display panel 110 may be divided into a plurality of blocks, and a plurality of subpixels SP may be included in the area occupied by each block.

Figure 5:
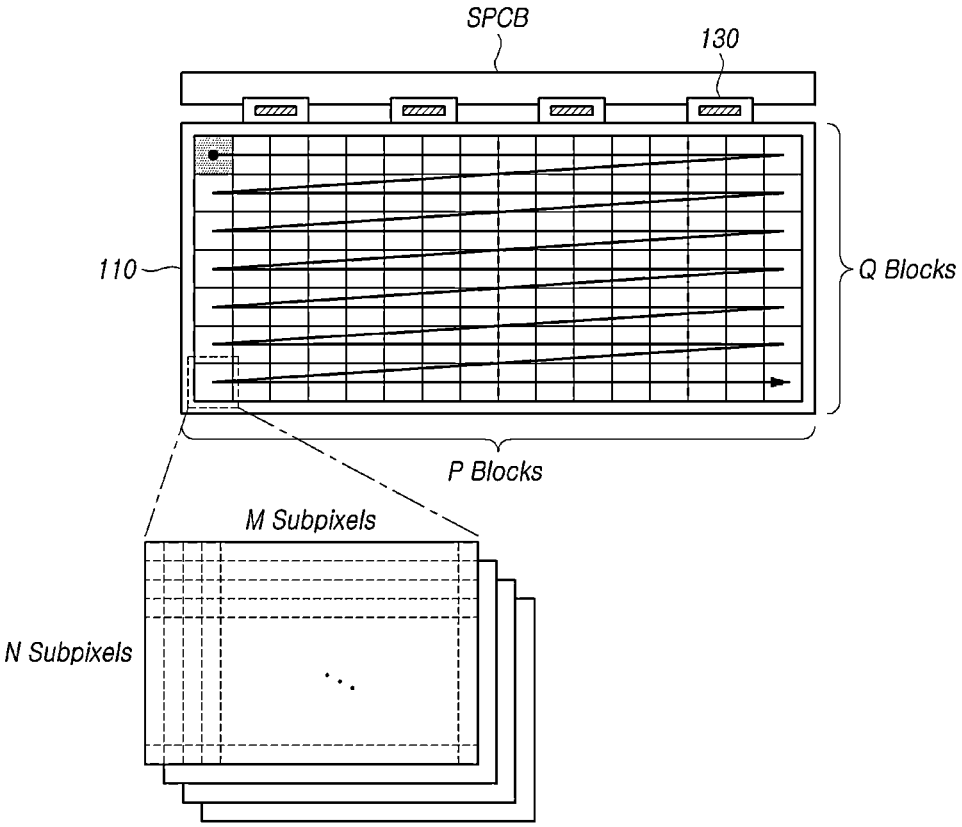
FIG. 5 is a view illustrating an example of dividing a display panel into a plurality of blocks in a display device according to embodiments of the present disclosure.

FIG. 5 is a view illustrating an example of dividing a display panel into a plurality of blocks in a display device according to embodiments of the present disclosure.

Referring to FIG. 5, in the display device 100 according to embodiments of the present disclosure, the display panel 110 may be divided into P×Q blocks each of which may include M×N subpixels SP.

In this case, subpixels SP having the same color may be bundled up into one block.

Each block may include the same number of subpixels SP, or at least one or more blocks may include different numbers of subpixels SP.

For example, in the display panel 110 having a resolution of 2,160×3,840, when each block is composed of 10×10 subpixels SP, the display panel 110 may be divided into 216×384 blocks, and each block may be composed of 10×10 subpixels SP.

When the display panel 110 is so divided into a plurality of blocks, the driving current for a specific block may be detected by summating the driving currents flowing in the display panel 110, with the specific block turned on, and the other blocks turned off.

If a predetermined level of driving current is flowed even in a state in which the specific block of the display panel 110 is turned off, it is possible to detect the driving current of each block using the driving current flowing with the entire display panel 110 turned off and the driving current flowing with the specific block turned on.

Such driving current per block unit may be detected per frame, and the driving current per block unit detected per frame may be stored in the memory.

Figure 6:
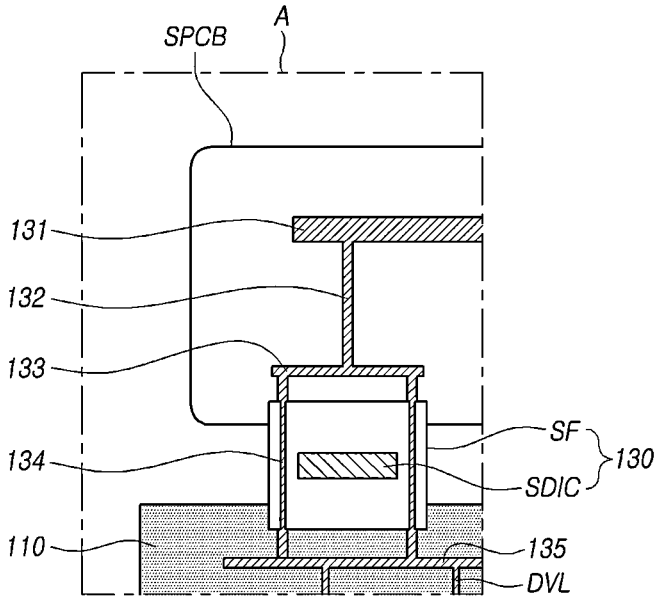
FIG. 6 is a view illustrating an example of a transfer path of a driving voltage in a display device according to embodiments of the present disclosure.

FIG. 6 is a view illustrating an example of a transfer path of a driving voltage in a display device according to embodiments of the present disclosure.

Here, portion A shown in FIG. 2 is enlarged and illustrated.

Referring to FIG. 6, in the display device 100 according to embodiments of the present disclosure, a plurality of subpixels SP defined by a plurality of data lines DL and a plurality of gate lines GL crossing each other are disposed on the display panel 110.

In this case, each subpixel SP receives the driving voltage EVDD through a plurality of driving voltage lines DVL arranged in a direction parallel to the plurality of data lines DL.

The plurality of driving voltage lines DVL may be formed between the plurality of data lines DL to be parallel to the plurality of data lines DL or may be formed to be shared by two subpixels adjacent to each other in the left and right directions.

The plurality of driving voltage lines DVL may be commonly connected to the common driving voltage line 135 formed in the upper non-display area of the display panel 110.

The driving voltage EVDD transferred from the power management circuit 150 is supplied to the common driving voltage line 135 through the plurality of data driving circuits 130.

To transfer the driving voltage EVDD to the plurality of driving voltage lines DVL, a first driving voltage supply line 131, a second driving voltage supply line 132, a third driving voltage supply line 133, and a fourth driving voltage supply line 134 may be disposed.

The first driving voltage supply line 131, the second driving voltage supply line 132, and the third driving voltage supply line 133 may be electrically connected to the source printed circuit board SPCB.

The fourth driving voltage supply line 134 may be branched to two opposite sides of the source driving integrated circuit SDIC in the data driving circuit 130 and may electrically connect the third driving voltage supply line 133 with the common driving voltage line 135.

The third driving voltage supply line 133 may be disposed in an area adjacent to the source film SF and may be electrically connected to the fourth driving voltage supply line 134 formed in the data driving circuit 130.

Since the first driving voltage supply line 131 corresponds to a portion to which the driving voltage EVDD supplied from the power management circuit 150 is applied at once, the first driving voltage supply line 131 may be formed to have a relatively larger area than the third driving voltage supply line 133.

The second driving voltage supply line 132 may be branched from the first driving voltage supply line 131 to have a predetermined interval and is connected to the third driving voltage supply line 133.

In this case, since the second driving voltage supply line 132 is positioned in an area before the driving voltage EVDD is branched through the plurality of driving voltage lines DVL, the second driving voltage supply line 132 has a relatively high current density as compared to the fourth driving voltage supply line 134 and the driving voltage line DVL.

Accordingly, the second driving voltage supply line 132 has a high chance of an increase in temperature and a defect due to the high-density current.

Meanwhile, the data driving circuit 130 may form several source driving integrated circuits SDIC into a group to supply the driving voltage EVDD on a basis of group unit.

Figure 7:
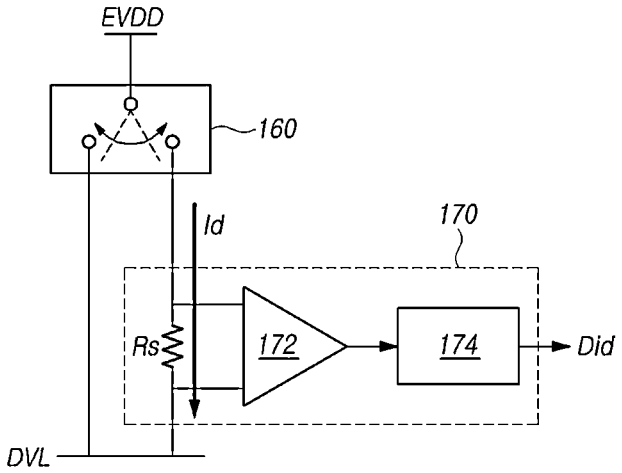
FIG. 7 is a view illustrating an example of a circuit for detecting a driving current for each block in a display device according to embodiments of the present disclosure.

FIG. 7 is a view illustrating an example of a circuit for detecting a driving current for each block in a display device according to embodiments of the present disclosure.

Referring to FIG. 7, a display device 100 according to embodiments of the present disclosure may include a switching circuit 160 for controlling a path of a driving current and a driving current detecting circuit 170.

The switching circuit 160 controls the path of the driving current Id so that the driving current Id by the driving voltage EVDD is bypassed to the driving voltage line DVL or transferred through the driving current detecting circuit 170.

During a display driving period when an image is displayed on the display panel 110, the driving current Id may be bypassed to the driving voltage line DVL.

To compensate for the characteristic value of the driving transistor DRT, the driving current Id may be transferred through the driving current detecting circuit 170 during the period when the driving current Id is detected.

The driving current detecting circuit 170 may include a current sensing resistor Rs, an operational amplifier 172, and an analog-to-digital converter 174.

The current sensing resistor Rs may be connected between the terminal to which the driving voltage EVDD is supplied and the data driving circuit 130, generating a bias voltage according to the driving current Id flowing from the power management circuit 150 to the data driving circuit 130.

In this case, the current sensing resistor Rs may have a tiny resistance, e.g., 0.01Ω, to minimize the voltage drop of the driving voltage EVDD.

The operational amplifier 172 may be connected between both the ends of the current sensing resistor Rs, sensing and amplifying the bias voltage applied between both the ends of the current sensing resistor Rs. For example, the operational amplifier 172 may amplify the bias voltage applied between both the ends of the current sensing resistor Rs, five times or more.

The analog-to-digital converter 174 converts the driving current Id flowing through a specific block during one frame based on the bias voltage amplified by the operational amplifier 172, generating driving current data Did.

The driving current data Did may be provided to the timing controller 140, and the timing controller 140 may store the driving current data Did detected from each block in the memory.

In the shown example, the driving current Id is measured by the driving voltage EVDD, and the current sensing resistor Rs is connected in series between the driving voltage EVDD and the data driving circuit 130.

In contrast, when the driving voltage EVDD is measured, a signal line transferring the data voltage EVDD between the data voltage EVDD and the data driving circuit 130 and a dummy channel may be disposed in parallel, and the variation in the data voltage EVDD may be measured through the dummy channel.

Figure 8:
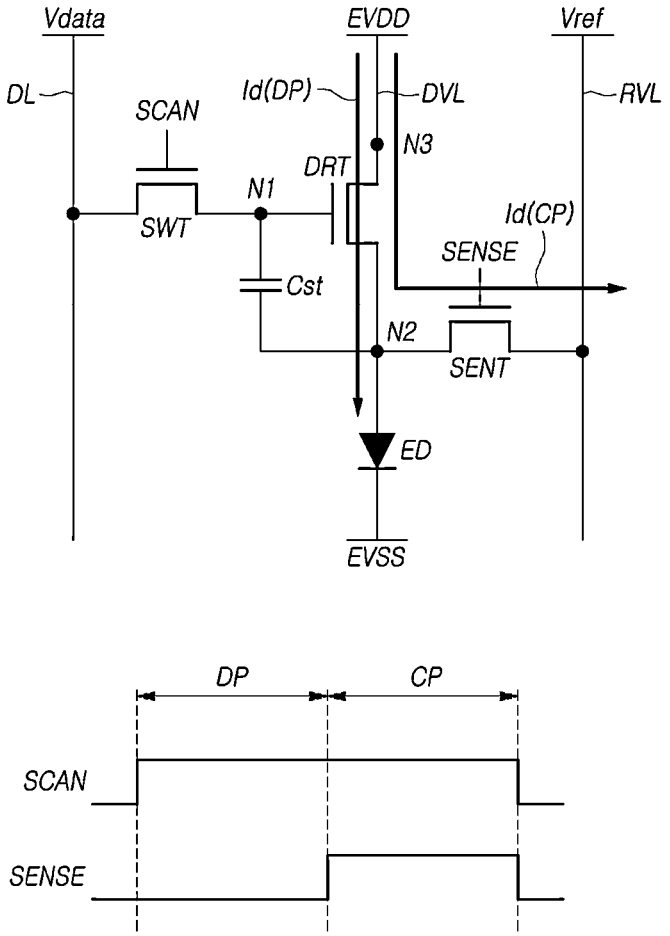
FIG. 8 is a view illustrating an example of a path of a driving current during a display driving period and during a driving current detecting period in a display device according to embodiments of the present disclosure.

FIG. 8 is a view illustrating an example of a path of a driving current during a display driving period and during a driving current detecting period in a display device according to embodiments of the present disclosure.

Referring to FIG. 8, according to embodiments of the present disclosure, in the display device 100, a driving current Id may be supplied to the light emitting element ED through the driving voltage line DVL during a display driving period DP when an image is displayed on the display panel 110.

To that end, during the display driving period DP when the image is displayed on the display panel 110, the switching transistor SWT is turned on by the scan signal SCAN, and the sensing transistor SENT is turned off by the sense signal SENSE.

Accordingly, the driving current Id(DP) flowing to the subpixel SP during the display driving period DP is supplied to the light emitting element ED so that an image corresponding to the data voltage Vdata is displayed.

In contrast, the driving current Id(CP) flowing to the subpixel SP during a driving current detecting period CP for compensating for the characteristic value of the driving transistor DRT may not be supplied to the light emitting element ED to prevent the light emitting element ED from displaying an image.

To that end, during the driving current detecting period CP for compensating for the characteristic value of the driving transistor DRT, the switching transistor SWT may be turned on by the scan signal SCAN, and the sensing transistor SENT may be turned on by the sense signal SENSE.

Accordingly, the driving current Id(CP) flowing to the subpixel SP during the driving current detecting period CP may be transferred through the reference voltage line RVL.

The step S200 of comparing the driving current at the current time with the driving current at the previous time is a process for comparing the driving current Id detected for a specific block in the current frame with the driving current Id detected and stored for the same block in the previous frame.

The comparing process may determine that degradation of the characteristic value in a specific block has not occurred if the magnitude of the driving current Id detected for the specific block in the current frame is not reduced as compared with the previous frame and omit the process for detecting the driving current Id and performing compensation.

However, such a comparing process may be omitted and, even when the step S200 of comparing the driving current at the current time with the driving current at the previous current is omitted, the process for detecting the driving current Id for each block every frame or predetermined time and performing compensation may be performed.

The step S300 of scaling the driving current data per block unit to the driving current data per subpixel SP unit is a process for converting the driving current data detected for a specific block including a plurality of subpixels SP into data for each of the plurality of subpixels SP included in the block.

Figure 9:
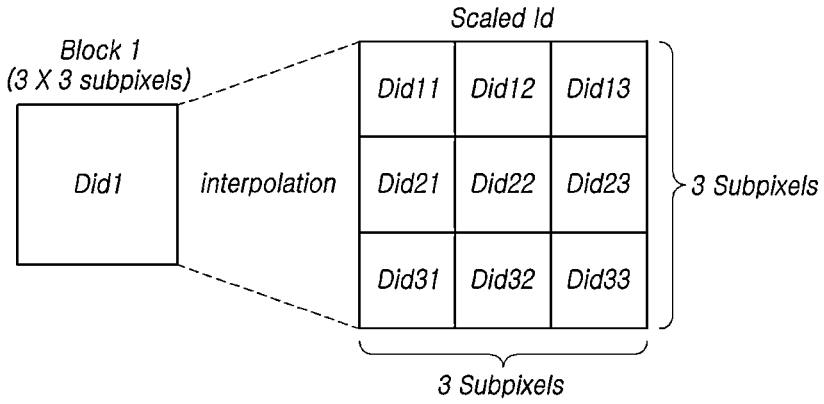
FIG. 9 is a view illustrating an example of a process of scaling a driving current per block unit to a driving current per subpixel unit in a display device according to embodiments of the present disclosure.

FIG. 9 is a view illustrating an example of a process of scaling a driving current per block unit to a driving current per subpixel unit in a display driving method according to embodiments of the present disclosure.

Referring to FIG. 9, the display device 100 according to embodiments of the present disclosure may scale driving current data Did detected for each specific block to data for each subpixel SP included in the block, with the display panel 110 divided into blocks including a plurality of subpixels SP.

For example, first driving current data Did1 detected for a first block Block 1 including 3×3 subpixels SP may correspond to the driving currents Id flowing to the nine subpixels SP included in the first block Block 1. Accordingly, first block driving current data Did1 corresponds to a value representing the first block Block 1.

In this case, the subpixel driving currents individually flowing to the nine subpixels SP included in the first block Block 1 may have the same or different values.

Accordingly, the first block driving current data Did1 detected in the first block Block 1 may be divided by 9 to be scaled to nine identical subpixel driving current data Did11 to Did33 or may be scaled to different subpixel driving current data Did11 to Did33 by applying interpolation.

However, the block of the display panel 110 may be divided into subpixels SP having the same color or may be divided by other various criteria. Thus, the position of the subpixel SP in the block may be varied. Accordingly, if the block driving current data is divided by the number of subpixels SP included in the block, the subpixel (SP) driving current data may be inaccurate. Thus, it may be preferable to perform scaling by applying interpolation.

For scaling into a plurality of subpixel driving current data Did11 to Did33 by applying interpolation, at least one or more of various interpolation methods including linear interpolation (e.g., bilinear interpolation), bicubic interpolation, and spline interpolation may be used.

The step S400 of calculating first compensation data by comparing the driving current data per subpixel SP unit with target data is a process for compensating for the deviation between the driving current data per subpixel SP unit generated by scaling the driving current data per block unit with the target luminance of the display panel 110.

Figure 10:
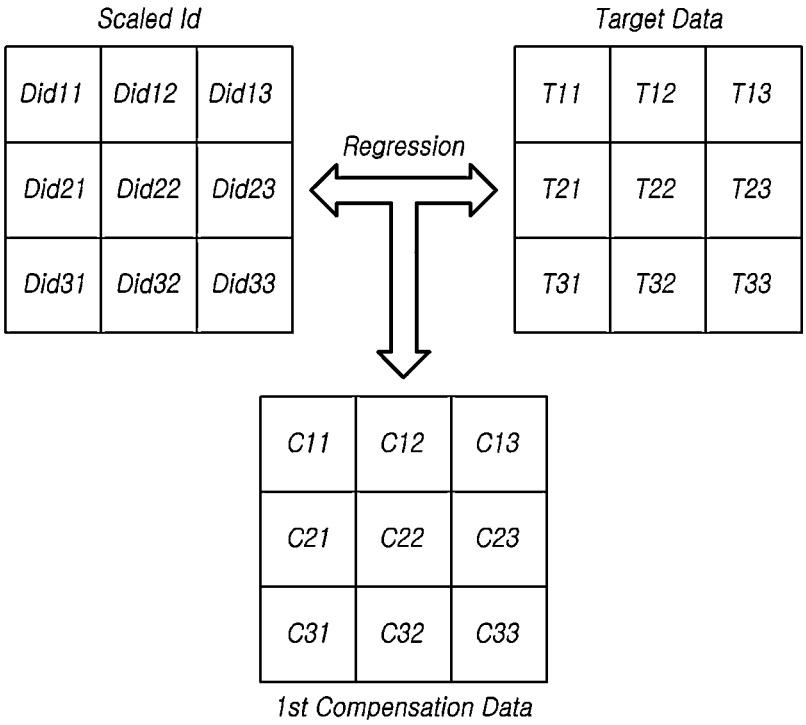
FIG. 10 is a view illustrating an example of a process of calculating a first compensation data by comparing driving current data per subpixel unit with target data in a display driving method according to embodiments of the present disclosure.

FIG. 10 is a view illustrating an example of a process of calculating a first compensation data by comparing driving current data per subpixel unit with target data in a display driving method according to embodiments of the present disclosure.

Referring to FIG. 10, the display device 100 according to embodiments of the present disclosure may generate target data corresponding to the display panel 110, extract target data having the same resolution as the driving current data per subpixel unit, and compare them.

In this case, the target data may correspond to ideal data where the subpixel SP disposed on the display panel 110 generates luminance by the data voltage Vdata. For example, the target data may be luminance-related data set to each subpixel SP at the time when the display device 100 according to embodiments of the present disclosure is manufactured and shipped.

Alternatively, luminance-related data set through an off-sensing process in which a power off signal is generated in the display device 100, and characteristic value sensing is performed with the data voltage Vdata blocked may be used as the target data.

The target data may be stored in the memory. The timing controller 140 may compare the driving current data per subpixel unit with the target data, calculating the first compensation data.

For example, the driving current data per subpixel unit Did11 to Did33 composed of 3×3 subpixels SP may be compared with the target data T11 to T33 having a 3×3 resolution, generating the first compensation data C11 to C33.

In this case, it is possible to generate the first compensation data C11 to C33 by compensating for the deviation between the driving current data per subpixel unit Did11 to Did33 and the target data T11 to T33. Alternatively, the first compensation data C11 to C33 may be generated by performing regression analysis on the driving current data per subpixel unit Did11 to Did33 and the target data T11 to T33.

As described above, the block of the display panel 110 may be divided into subpixels SP having the same color or may be divided by other various criteria. Thus, the position of the subpixel SP in the block may be varied. Accordingly, the first compensation data C11 to C33 generated by compensating for the deviation between the driving current data per subpixel unit Did11 to Did33 and the target data T11 to T33 may be inaccurate. Thus, it is preferable to generate the first compensation data C11 to C33 by applying regression analysis.

The step S500 of calculating final compensation data by comparing the first compensation data with the guide data is a process for correcting an error in the first compensation data C11 to C33 by applying the guide data generated by reflecting the degradation characteristic of the display panel 110.

Figure 11:
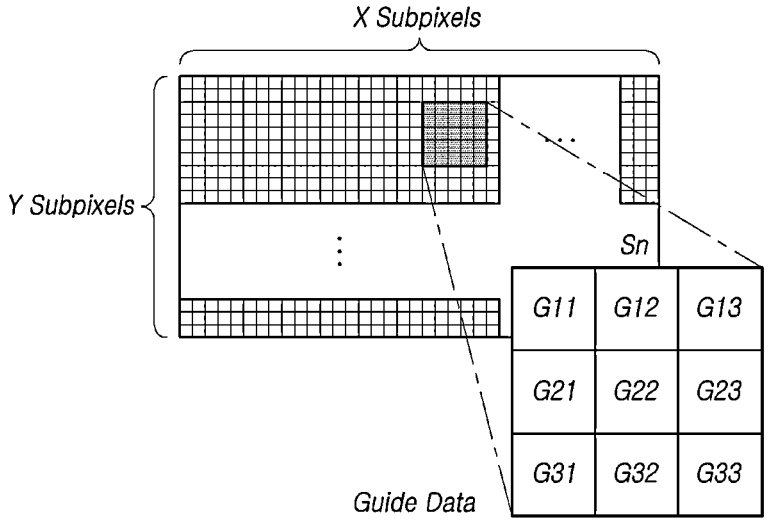
FIG. 11 is a view illustrating an example of guide data in a display driving method according to embodiments of the present disclosure.
Figure 12:
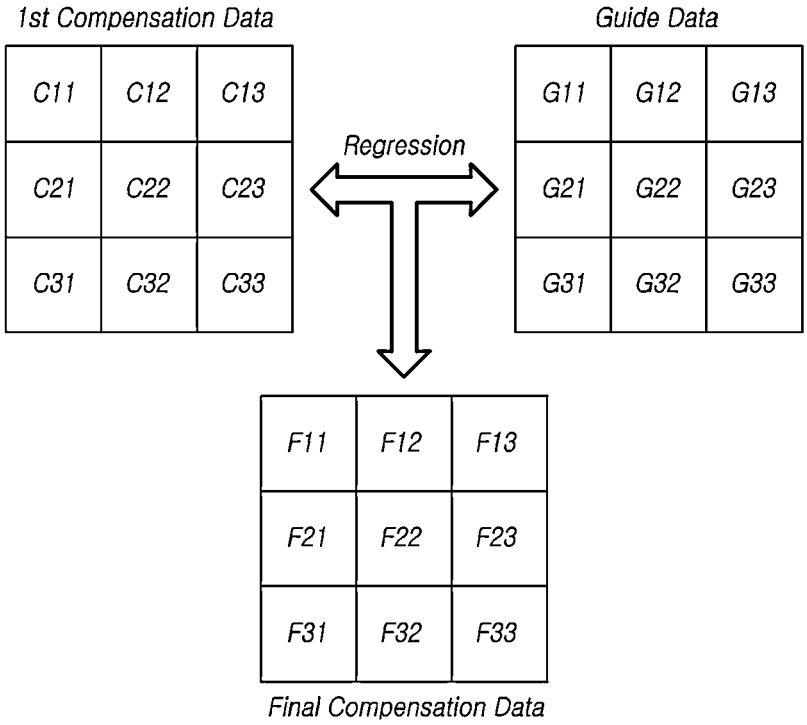
FIG. 12 is a view illustrating an example of a process of calculating final compensation data by comparing first compensation data with guide data in a display driving method according to embodiments of the present disclosure.

FIG. 11 is a view illustrating an example of guide data in a display driving method according to embodiments of the present disclosure. FIG. 12 is a view illustrating an example of a process of calculating final compensation data by comparing first compensation data with guide data in a display driving method according to embodiments of the present disclosure.

Referring to FIGS. 11 and 12, the display device 100 according to embodiments of the present disclosure may generate guide data corresponding to the display panel 110, extract guide data having the same resolution as the first compensation data, and compare them.

In this case, the guide data may correspond to the data reflecting the degree of degradation of the subpixel SP disposed on the display panel 110. For example, the guide data may be luminance-related data set by applying the realtime sensing process of the display panel 110.

For example, in a case where luminance-related data set to each subpixel SP at the time when the display device 100 is shipped is used as the target data, luminance-related data set by applying the realtime sensing process of the display panel 110 or an off-sensing process in which characteristic value sensing is performed with the data voltage Vdata blocked as a power off signal is generated in the display device 100 may be used as the guide data.

In contrast, in a case where luminance-related data set by applying the off-sensing process in which characteristic value sensing is performed with the data voltage Vdata blocked as a power off signal is generated in the display device 100 is used as the target data, the luminance-related data set by applying the realtime sensing process of the display panel 110 may be used as the guide data.

The guide data may be stored in the memory, and the timing controller 140 may produce final compensation data by comparing the first compensation data with the guide data.

For example, when the display panel 110 has a resolution of X subpixels SP in the horizontal direction and Y subpixels SP in the vertical direction, guide data having the same resolution as the display panel 110 may be generated.

In this case, if the first compensation data is composed of 3×3 subpixels SP, guide data G11 to G33 having a size of 3×3 is extracted from the guide data. As such, the guide data G11 to G33 having the same resolution as the first compensation data may be used as a kernel Sn to be compared with the first compensation data C11 to C33.

Of the kernel Sn, the first guide data G1=G11, the second guide data G2=G12, and the kth guide data is $G_k$.

The final compensation data F11 to F33 may be generated through regression analysis on the first compensation data C11 to C33 and the guide data G11 to G33. For efficient computation, the guide data G11 to G33 and the final compensation data F11 to F33 may be defined to have a linear relationship.

For example, the kth final compensation data $D_{out,\,k}$ may be determined by applying the weight $p_n$ and the bias $q_n$ to the kth guide data $G_k$.

$$D_{out,k}=p_nG_k+q_n,\ \forall k=S_n$$

Here, the weight $P_n$ and the bias $q_n$ need to be determined so that the loss function $E(p_n, q_n)$ defining the difference between the kth final compensation data $D_{out,\,k}$ and the first compensation data is minimized.

$$E(p_n, q_n) = \sum_{k\in S_n} \left((p_nG_k + q_n - D_{in,k})^2 + \lambda p_n^2\right)$$

Here, $D_{in,\,k}$ corresponds to the kth first compensation data, and λ is a regulation term, which serves to eliminate or minimize a specific weight to prevent overfitting of the regression analysis.

As described above, the block of the display panel 110 may be divided into subpixels SP having the same color or may be divided by other various criteria. Thus, the position of the subpixel SP in the block may be varied. Accordingly, the final compensation data F11 to F33 generated by compensating for the deviation between the first compensation data C11 to C33 and the guide data G11 to G33 may be inaccurate. Thus, it is preferable to generate the final compensation data F11 to F33 by applying regression analysis.

In this case, since the loss function $E(p_n, q_n)$ may match the form of ridge regression analysis among several regression analysis methods, the weight $p_n$ and the bias $q_n$ may be represented as follows, by applying a general solution for the ridge regression analysis.

$$p_n = \frac{\frac{1}{|S|}\sum_{k\in S}(G_k D_{in,k}) - m_n \overline{D}_{in,n}}{\sigma_n^2 + \lambda}$$

$$q_n = \overline{D}_{in,n} - m_n p_n$$

Here, $m_n$ means the mean guide data for the kernel $S_n$ for the guide data, $\sigma_n$ means the standard deviation of the guide data for the kernel $S_n$, and $\overline{D}_{in,n}$ means the mean first compensation data.

The display device 100 according to embodiments of the present disclosure may determine the optimized final compensation data by using the above-described method.

The step S600 of compensating for the characteristic value of the driving transistor DRT based on the final compensation data is a process for compensating for the degradation of characteristic value of the driving transistor DRT by controlling the data voltage Vdata applied to a designated subpixel SP by using the final compensation data in the timing controller 140.

Figure 13:
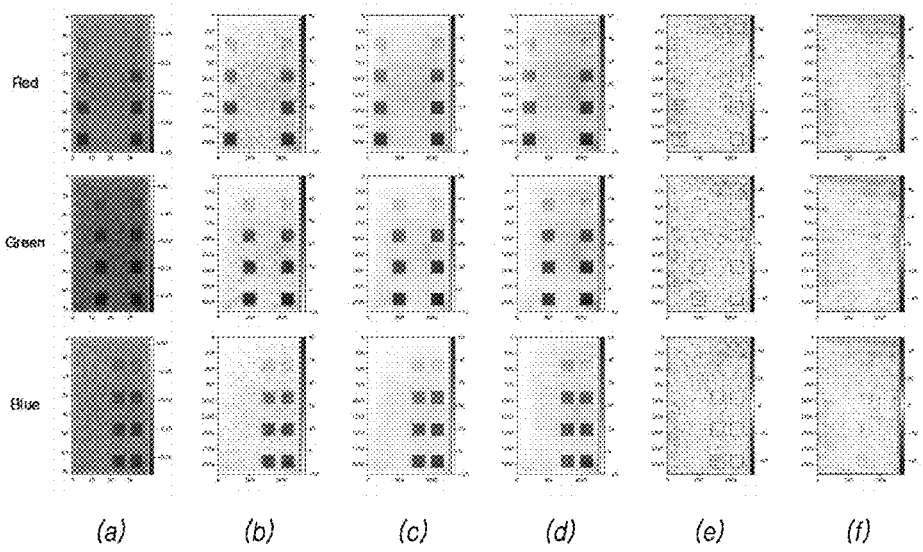
FIG. 13 is a view illustrating an example of a data distribution of a display panel when performing characteristic value compensation using a display driving method according to embodiments of the present disclosure.

FIG. 13 is a view illustrating an example of a data distribution of a display panel when performing characteristic value compensation using a display driving method according to embodiments of the present disclosure.

The (a) of FIG. 13 illustrates distributions of block driving current data detected per block unit in the display panel 110, for red, green, and blue.

The (b) of FIG. 13 illustrates distributions of first compensation data generated through regression analysis on target data and driving current data per subpixel unit to which driving current data per block unit has been scaled, and the (c) of FIG. 13 illustrates distributions of final compensation data generated through regression analysis on the first compensation data and guide data. The (d) of FIG. 13 illustrates distributions of target data.

As shown in FIG. 13, it may be identified that the luminance deviation may be mitigated and uniformity between adjacent subpixels are further enhanced by the final compensation data (case (c)) generated using target data along with the guide data corresponding to the state of degradation of the display panel 110, as compared with the first compensation data (case (b)) generated using only the target data corresponding to the target luminance of the display panel 110.

For reference, the (e) of FIG. 13 illustrates the deviation between the first compensation data (case (b)) and the target data (case (d)), and the (f) of FIG. 13 illustrates the deviation between the final compensation data (case (c)) and the target data (case (d)).

As described above, the display driving method according to embodiments of the present disclosure may compute final compensation data at high speed by using driving current data per block unit and may generate final compensation data through target data and guide data, thereby mitigating the deviation between adjacent subpixels SP and enhancing uniformity and the effect of compensating for the characteristic value of the driving transistor DRT.

The foregoing embodiments are briefly described below.

A display driving method according to embodiments of the present disclosure may comprise a step S100 of detecting a driving current per block unit for a display panel 110 including a plurality of subpixels SP, a step S300 of scaling driving current data per block unit to driving current data per subpixel unit, a step S400 of calculating first compensation data by comparing the driving current data per subpixel unit with target data, a step S500 of calculating final compensation data by comparing the first compensation data with guide data, and a step S600 of compensating for a characteristic value for the plurality of subpixels based on the final compensation data.

The display driving method according to embodiments of the present disclosure may further comprise a step S200 of comparing the driving current per block unit with a driving current per block unit detected at a previous time after detecting the driving current per block unit.

The display driving method according to embodiments of the present disclosure may perform a subsequent process only when a magnitude of the driving current per block unit is smaller than a magnitude of the driving current per block unit detected at the previous time.

The step S300 of scaling may be performed by at least one of linear interpolation, bicubic interpolation, or spline interpolation.

The target data may correspond to luminance data set for the plurality of subpixels SP at a time of shipment of the display panel 110.

The guide data may correspond to luminance data set by applying an off-sensing process in which characteristic value sensing is performed with a data voltage Vdata blocked as a power off signal is generated in the display panel 110 or a realtime sensing process of the display panel 110.

The target data may correspond to luminance data set through an off-sensing process in which characteristic value sensing is performed with a data voltage Vdata blocked as a power off signal is generated in the display panel 110.

The guide data may correspond to luminance data set by applying a realtime sensing process of the display panel 110.

Calculating the first compensation data and calculating the final compensation data may be performed by regression analysis.

Calculating the final compensation data may include determining kth final compensation data $D_{out,k}$ according to:

$$D_{out,k} = p_n G_k + q_n$$

wherein $G_k$ is kth guide data, $p_n$ is a weight, and $q_n$ is a bias.

In the kth final compensation data $D_{out,k}$, the weight $p_n$ and the bias $q_n$ may be determined so that a loss function $E(p_n, q_n)$ is minimized by:

$$E(p_n, q_n) = \sum_{k\in S_n}\left((p_n G_k + q_n - D_{in,k})^2 + \lambda p_n^2\right)$$

wherein $D_{in,k}$ is kth first compensation data, and $\lambda$ is a regulation term.

In the loss function $E(p_n, q_n)$, the weight $p_n$ and bias $q_n$ may be determined by:

$$p_n = \frac{\frac{1}{|S|}\sum_{k\in S}(G_k D_{in,k}) - m_n \overline{D}_{in,n}}{\sigma_n^2 + \lambda}$$

$$q_n = \overline{D}_{in,n} - m_n p_n$$

Here Sn is a kernel composed of n guide data, $m_n$ is mean guide data, $\sigma_n$ is a standard deviation of the guide data for the kernel Sn, and $\overline{D}_{in,n}$ is mean first compensation data.

A display device according to embodiments of the present disclosure may comprise a display panel 110 where a plurality of subpixels SP are disposed, a data driving circuit 130 configured to supply a data voltage Vdata to the display panel 110, a power management circuit 150 configured to supply a driving current to the display panel 110 through a driving voltage line DVL, a driving current detecting circuit 170 configured to detect a driving current per block unit for the display panel 110, and a timing controller 140 configured to scale driving current data per block unit generated from the driving current detecting circuit 170 to driving current data per subpixel unit, calculate first compensation data by comparing the driving current data per subpixel unit with target data, calculate final compensation data by comparing the first compensation data with guide data, and compensate for a characteristic value for the plurality of subpixels based on the final compensation data.

The driving current detecting circuit 170 may include a current sensing resistor Rs connected between a terminal to which the driving current is supplied and the data driving circuit 130, an operational amplifier 172 connected to two opposite ends of the current sensing resistor Rs to sense and amplify a bias voltage applied to the two opposite ends of the current sensing resistor Rs, and an analog-to-digital converter 174 generating the driving current data per block unit based on the bias voltage amplified by the operational amplifier 172.

The display device 100 may further comprise a switching circuit 160 configured to bypass the driving current to the driving voltage line during a display driving period when an image is displayed on the display panel 110 and transferring the driving current to the driving current detecting circuit 170 during a period when the image is not displayed on the display panel 110.

The target data may correspond to luminance data set for the plurality of subpixels SP at a time of shipment of the display panel 110.

The guide data may correspond to luminance data set by applying an off-sensing process in which characteristic value sensing is performed with a data voltage Vdata blocked as a power off signal is generated in the display panel 110 or a realtime sensing process of the display panel 110.

The target data may correspond to luminance data set through an off-sensing process in which characteristic value sensing is performed with a data voltage Vdata blocked as a power off signal is generated in the display panel 110.

The guide data may correspond to luminance data set by applying a realtime sensing process of the display panel 110.

The first compensation data and the final compensation data may be determined by regression analysis.

It will be apparent to those skilled in the art that various modifications and variations can be made in the display device and the display driving method of the present disclosure without departing from the technical idea or scope of the disclosure. Thus, it is intended that the present disclosure cover the modifications and variations of this disclosure provided they come within the scope of the appended claims and their equivalents.

What is claimed is:

1. A display driving method, comprising:

detecting a driving current per block unit for a display panel including a plurality of subpixels;

scaling driving current data per block unit to driving current data per subpixel unit;

calculating first compensation data by comparing the driving current data per subpixel unit with target data;

calculating final compensation data by comparing the first compensation data with guide data; and compensating for a characteristic value for the plurality of subpixels based on the final compensation data.

2. The display driving method of claim 1, further comprising, comparing the driving current per block unit with a driving current per block unit detected at a previous time after detecting the driving current per block unit.

3. The display driving method of claim 2, wherein a subsequent process is performed only when a magnitude of the driving current per block unit is smaller than a magnitude of the driving current per block unit detected at the previous time.

4. The display driving method of claim 1, wherein the scaling is performed by at least one of linear interpolation, bicubic interpolation, or spline interpolation.

5. The display driving method of claim 1, wherein the target data corresponds to luminance data set for the plurality of subpixels at a time of shipment of the display panel.

6. The display driving method of claim 5, wherein the guide data corresponds to luminance data set by applying an off-sensing process in which characteristic value sensing is performed with a data voltage blocked as a power off signal is generated in the display panel or a realtime sensing process of the display panel.

7. The display driving method of claim 1, wherein the target data corresponds to luminance data set through an off-sensing process in which characteristic value sensing is performed with a data voltage blocked as a power off signal is generated in the display panel.

8. The display driving method of claim 7, wherein the guide data corresponds to luminance data set by applying a realtime sensing process of the display panel.

9. The display driving method of claim 1, wherein calculating the first compensation data and calculating the final compensation data are performed by regression analysis.

10. The display driving method of claim 1, wherein calculating the final compensation data includes determining kth final compensation data $D_{out,k}$ according to:

$$D_{out,k} = P_n G_k + q_n$$

wherein $G_k$ is kth guide data, $p_n$ is a weight, and $q_n$ is a bias.

11. The display driving method of claim 10, wherein in the kth final compensation data $D_{out,\ k}$, the weight $p_n$ and the bias ($q_n$) are determined so that a loss function $E(p_n, q_n)$ is minimized by:

$$E(p_n, q_n) = \sum_{k \in S_n} \left( (p_n G_k + q_n - D_{in,k})^2 + \lambda p_n^2 \right)$$

wherein $D_{in,\ k}$ is kth first compensation data, and $\lambda$ is a regulation term.

12. The display driving method of claim 11, wherein in the loss function $E(p_n, q_n)$, the weight $p_n$ and bias $q_n$ are determined by:

$$p_n = \frac{\frac{1}{|S|} \sum_{k \in S_n} (G_k D_{in,k}) - m_n \overline{D}_{in,n}}{\sigma_n^2 + \lambda}$$

$$q_n = \overline{D}_{in,n} - m_n p_n$$

wherein Sn is a kernel composed of n guide data, $m_n$ is mean guide data, $\sigma_n$ is a standard deviation of the guide data for the kernel Sn, and $\overline{D}_{in,n}$ is mean first compensation data.

13. A display device, comprising:

a display panel including a plurality of subpixels;

a data driving circuit configured to supply a data voltage to the display panel;

a power management circuit configured to supply a driving current to the display panel through a driving voltage line;

a driving current detecting circuit configured to detect a driving current per block unit for the display panel; and a timing controller configured to scale driving current data per block unit generated from the driving current detecting circuit to driving current data per subpixel unit, calculate first compensation data by comparing the driving current data per subpixel unit with target data, calculate final compensation data by comparing the first compensation data with guide data, and compensate for a characteristic value for the plurality of subpixels based on the final compensation data.

14. The display device of claim 13, wherein the driving current detecting circuit includes:

a current sensing resistor connected between a terminal to which the driving current is supplied and the data driving circuit;

an operational amplifier connected to two opposite ends of the current sensing resistor to sense and amplify a bias voltage applied to the two opposite ends of the current sensing resistor; and an analog-to-digital converter configured to generate the driving current data per block unit based on the bias voltage amplified by the operational amplifier.

15. The display device of claim 13, further comprising a switching circuit configured to bypass the driving current to the driving voltage line during a display driving period when an image is displayed on the display panel and transfer the driving current to the driving current detecting circuit during a period when the image is not displayed on the display panel.

16. The display device of claim 13, wherein the target data corresponds to luminance data set for the plurality of subpixels at a time of shipment of the display panel.

17. The display device of claim 16, wherein the guide data corresponds to luminance data set by applying an off-sensing process in which characteristic value sensing is performed with a data voltage blocked as a power off signal is generated in the display panel or a realtime sensing process of the display panel.

18. The display device of claim 13, wherein the target data corresponds to luminance data set through an off-sensing process in which characteristic value sensing is performed with a data voltage blocked as a power off signal is generated in the display panel.

19. The display device of claim 18, wherein the guide data corresponds to luminance data set by applying a realtime sensing process of the display panel.

20. The display device of claim 13, wherein the first compensation data and the final compensation data are determined by regression analysis.

* * * * *